US008801148B2

(12) United States Patent
Izawa et al.

(10) Patent No.: US 8,801,148 B2
(45) Date of Patent: Aug. 12, 2014

(54) INKJET RECORDING APPARATUS

(75) Inventors: Hideo Izawa, Chiba (JP); Takao Namiki, Chiba (JP); Kouichi Ooyama, Akita (JP); Masahito Sato, Akita (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 267 days.

(21) Appl. No.: 13/135,751

(22) Filed: Jul. 14, 2011

(65) Prior Publication Data

US 2012/0019599 A1 Jan. 26, 2012

(30) Foreign Application Priority Data

Jul. 23, 2010 (JP) ..... 2010-166568

(51) Int. Cl.
*B41J 2/14* (2006.01)
*B41J 2/16* (2006.01)

(52) U.S. Cl.
USPC ..... 347/49

(58) Field of Classification Search
None
See application file for complete search history.

(56) References Cited

U.S. PATENT DOCUMENTS

| | | | | |
|---|---|---|---|---|
| 6,068,374 | A * | 5/2000 | Kurata et al. | 347/108 |
| 6,575,557 | B2 * | 6/2003 | Tominaga | 347/37 |
| 7,540,604 | B2 | 6/2009 | Izawa et al. | |
| 2007/0035572 | A1 | 2/2007 | Izawa et al. | |
| 2010/0194814 | A1 * | 8/2010 | Izawa et al. | 347/16 |
| 2011/0102504 | A1 * | 5/2011 | Wanibe | 347/37 |
| 2011/0181658 | A1 * | 7/2011 | Izawa et al. | 347/34 |

FOREIGN PATENT DOCUMENTS

| | | | |
|---|---|---|---|
| JP | 2001-287352 | A | 10/2001 |
| JP | 2003-211053 | A | 7/2003 |
| JP | 2007-44949 | A | 2/2007 |

OTHER PUBLICATIONS

European Patent Office Search Report dated Nov. 17, 2011 (5 pages).

* cited by examiner

*Primary Examiner* — Stephen Meier
*Assistant Examiner* — Renee I Wilson
(74) *Attorney, Agent, or Firm* — Flynn, Thiel, Boutell & Tanis, P.C.

(57) ABSTRACT

An inkjet recording apparatus is provided that is easy to maintain and that is compact. The inkjet recording apparatus includes a line head capable of printing on a recording medium, and a housing with the line head attached, in which the line head is slid along a guide groove provided in the housing so that the line head is detachably attached.

8 Claims, 9 Drawing Sheets

INKJET RECORDING APPARATUS

TECHNICAL FIELD

The present invention relates to an inkjet recording apparatus, and more specifically, to an inkjet recording apparatus that is easy to maintain and is compact.

BACKGROUND ART

An inkjet recording apparatus having a line head has been used in many fields because it can print a desired design and letters.

When such an inkjet recording apparatus is used for a long period, a nozzle may be clogged, and ink may be contaminated. Therefore, maintenances such as cleaning and replacement of a head are periodically required.

However, a line head is heavy in weight because it carries a plurality of heads. The inkjet recording apparatus is complicated because it is a precision machine. Therefore, maintenance work is significantly difficult.

On the other hand, development of an inkjet recording apparatus capable of easily detachably attaching a line head has been considered to simplify maintenances.

For example, an inkjet recording apparatus, in which a controller housing is provided with a bracket for supporting a line head housing with the line head housing detachably attached in one direction, and is provided with a driving plate being made rotatable in the same plane as that in an elevating direction of the bracket, and the driving plate and the bracket are so adapted that the bracket moves up and down when the driving plate rotates, has been known (see, e.g., Patent Document 1).

An inkjet recording apparatus in which a line head housing is detachably attached to a controller housing, and the controller housing is movable between a printing position and a maintenance position beside the printing position (see, e.g., Patent Document 2).

PRIOR ART DOCUMENTS

Patent Documents

[Patent Document 1] Japanese Unexamined Patent Application Publication No. 2007-44949

[Patent Document 2] Japanese Unexamined Patent Application Publication No. 2007-136762

SUMMARY OF THE INVENTION

Problems that the Invention is to Solve

However, in the inkjet recording apparatus discussed in Patent Document 1 or 2, described above, the line head, together with the housing, is attached/detached. Therefore, the apparatus has disadvantages in that a load burden is great, and special equipment for attachment/detachment is required. The apparatus further has a disadvantage in that a complicated configuration of an attachment/detachment mechanism causes a device cost and a work procedure to be increased. From the foregoing, it cannot be said that its maintenance work is easy.

In order to slide, when the line head housing is attached/detached, the line head toward an adjacent line head and then remove the line head, its replacement space is required. Therefore, the apparatus has a disadvantage in that a wide installation space is required.

The present invention has been made in view of the above-mentioned circumference and is aimed to prove an inkjet recording apparatus that is easy to maintain and is compact.

Means for Solving the Problems

When the inventors of the present invention have earnestly made consideration to solve the above-mentioned problem, they have found out that the above-mentioned problem can be solved by forming a line head itself as one of a sliding type, to complete the present invention.

More specifically, the present invention resides in (1) an inkjet recording apparatus including a line head capable of printing on a recording medium, and a housing with the line head attached, in which the line head is slid along a guide groove provided in the housing so that the line head is detachably attached.

The present invention resides in (2) the inkjet recording apparatus described in the above-mentioned item (1) in which a front end of the line head is locked to the housing with a first positioning pin.

The present invention resides in (3) the inkjet recording apparatus described in the above-mentioned item (1) or (2), in which a cover positionally-fixed along the guide groove is disposed at a rear end of the line head, and the rear end of the line head is locked to the cover with a second positioning pin.

The present invention resides in (4) the inkjet recording apparatus described in the above-mentioned item (3), in which an adjustment device including the second positioning pin is attached to the cover, and the adjustment device enables the line head to slightly move.

The present invention resides in (5) the inkjet recording apparatus described in the above-mentioned item (4), in which the adjustment device includes a slide bracket with the second positioning pin attached, a slider fixed to the slide bracket, and a guide along which the slider slides, and the slide bracket and the slider are linearly movable along the guide fixed to the cover, and the line head is slightly movable by slightly moving the slide bracket.

The present invention resides in (6) the inkjet recording apparatus described in any one of the above-mentioned items (1) to (5), in which both side ends of the line head are urged toward a bottom plate of the housing at the same time that they are guided by a guiding device provided in the housing.

The present invention resides in (7) the inkjet recording apparatus described in the above-mentioned item (6), in which the guiding device includes a bracket, an urging plate attached to the bracket, and a spring member for urging the urging plate, and both the side ends of the line head are urged toward the bottom plate of the housing via the urging plate by an urging force of the spring member.

Advantage of the Invention

An inkjet recording apparatus according to the present invention becomes easy to maintain by being of an attachment/detachment type in which a housing is provided with a guide groove, and a line head itself is attached/detached by being slid along the guide groove. Further, the housing is positionally-fixed so that pitch matching of a nozzle can be easily performed when the line head is attached.

In the above-mentioned inkjet recording apparatus, special equipment for attaching/detaching the line head is not provided so that space saving and cost reduction can be achieved.

In the inkjet recording apparatus, when a front end of the line head is locked to the housing with a first positioning pin, pitch matching can be performed with high accuracy when the line head is attached to the housing.

When a rear end of the line head is locked to the housing via a cover with a second positioning pin, pitch matching can be performed with higher accuracy when the line head is attached to the housing.

When the above-mentioned cover includes an adjustment device, and the line head is slightly movable by slightly moving the adjustment device, the pitch matching can be finely adjusted easily.

In the inkjet recording apparatus, both side ends of the line head are urged toward a bottom plate of the housing by the guiding device provided in the housing, the line head is not completely fixed. Even if strain is generated due to a difference in coefficient of thermal expansion, therefore, a force can be released. Therefore, generation of a strain stress can be suppressed.

BEST MODE FOR CARRYING OUT THE INVENTION

Figure 1:
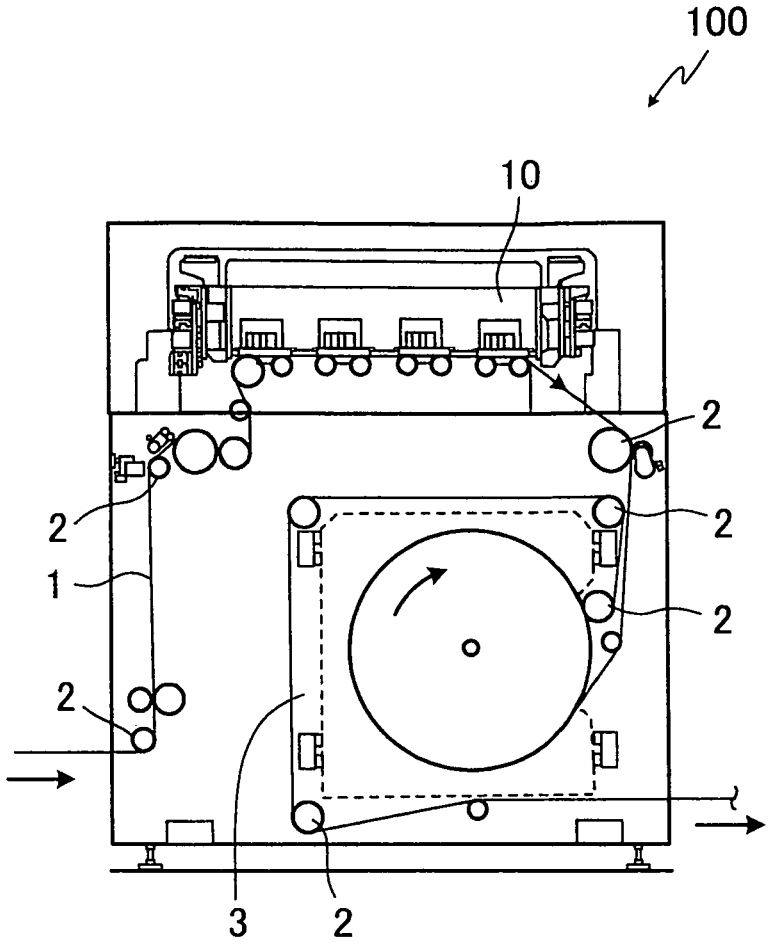
FIG. 1 is a front view illustrating an embodiment of an inkjet recording apparatus according to the present invention.

A preferred embodiment of the present invention will be described in detail while referring to figures, as needed. In the figures, the same elements are assigned the same reference numerals, and an overlapped description is omitted. A positional relationship such as the left, right, top and bottom is based on a positional relationship illustrated in the figures unless otherwise noted. Further, a dimensional ratio in the figures is not limited to a ratio as illustrated.

FIG. 1 is a front view illustrating an embodiment of an inkjet recording apparatus according to the present invention.

As illustrated in FIG. 1, an inkjet recording apparatus 100 according to the present embodiment includes an inkjet recording head unit 10 including a line head for printing on a recording medium 1 and a housing with the line head attached, a drier 3 positioned below the inkjet recording head unit 10 for heating and drying the recording medium 1 after the printing, and a plurality of guide rolls 2 for guiding the recording medium 1. More specifically, the inkjet recording apparatus 100 is an inkjet recording apparatus of a line head type having a line head.

In the inkjet recording apparatus 100, the recording medium 1 that has been carried in is guided by the guide rolls 2, to reach the bottom of the inkjet recording head unit 10. The line head provided in the inkjet recording head unit 10 prints the recording medium 1.

The printed recording medium 1 is guided by other guide rolls 2, to reach the dryer 3, where the recording medium 1 is dried. Then, the recording medium 1, which has been guided by the other guide rolls 2 and dried, is carried outward.

Figure 2:
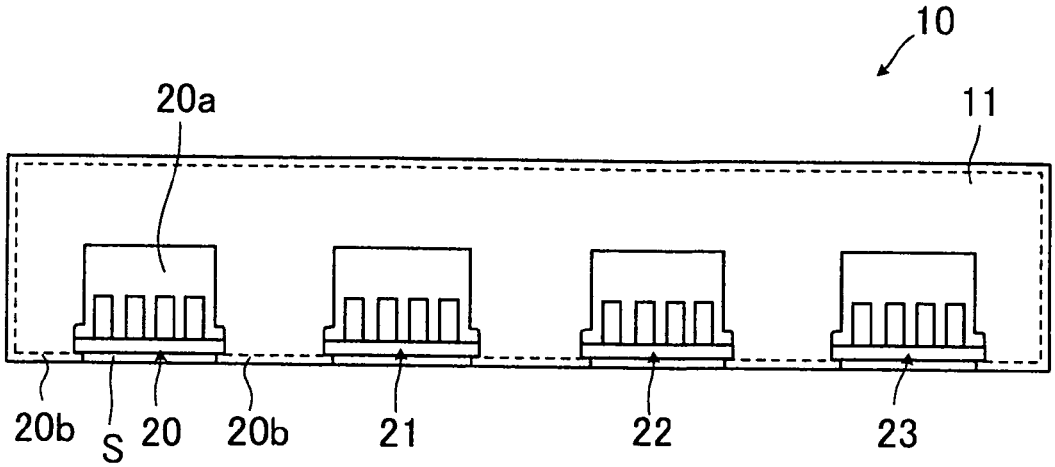
FIG. 2 is a front view illustrating a housing with a line head attached in the inkjet recording apparatus according to the present embodiment.

FIG. 2 is a front view illustrating the inkjet recording head unit in the inkjet recording apparatus according to the present embodiment.

As illustrated in FIG. 2, the inkjet recording head unit 10 includes four line heads 20, 21, 22, and 23 (hereinafter referred to as "20 to 23") capable of printing on a recording medium, and a housing 11 with the line heads 20 to 23 attached.

Therefore, the inkjet recording apparatus 100 can perform printing using four colors because it includes the four line heads. For example, the apparatus can perform full-color printing using Y, M, C, and K colors.

The housing 11 includes a bottom plate 20*b*, and a sidewall formed integrally with the bottom plate 20*b*. The bottom plate 20*b* has windows S formed therein, and the sidewall is provided with cutout portions 20*a* with the line heads attached respectively.

In the housing 11, the four line heads are attached via the four cutout portions 20*a*, and the bottom plate 20*b* supports each of the line heads.

The housing 11 is composed of a lightweight material such as an aluminum alloy, for example, and is hollow inside. Therefore, the whole inkjet recording apparatus 100 is made lightweight.

The housing 11 is positionally-fixed to a frame of the inkjet apparatus 100. Therefore, the line heads 20 to 23 are independently detachably attached, respectively, by being slid along a guide groove, described below, provided in the housing 11 positionally-fixed, Attachment/detachment of the line head 20 to/from the housing 11 will be described below. The same is true for the line heads 21, 22, and 23.

Figure 3:
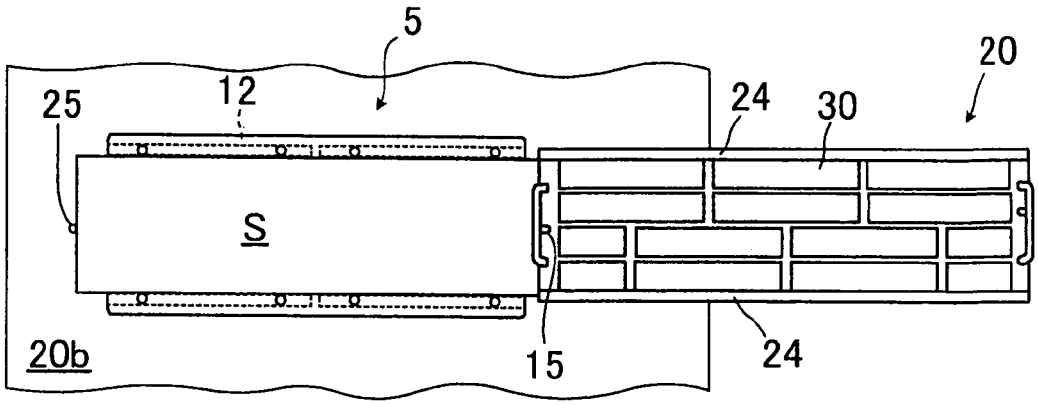
FIG. 3(*a*) is a top view illustrating a state where a line head has not been attached to a housing in the inkjet recording apparatus according to the present embodiment, and FIG. 3(*b*) is a top view illustrating a state where the line head has been attached to the housing.
Figure 3:
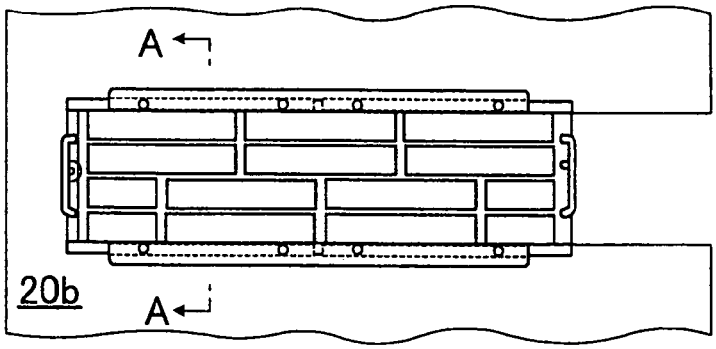

FIG. 3(*a*) is a top view illustrating a state where the line head has not been attached to the housing in the inkjet recording apparatus according to the present embodiment, and FIG. 3(*b*) is a top view illustrating a state where the line head has been attached to the housing.

As illustrated in FIG. 3(*a*), in the inkjet recording apparatus 100, the line head 20 includes a rectangular base plate 24 that can be inserted into a guide groove 12 in the housing 11, and a plurality of rectangular heads 30 disposed on the base plate 24, and a positioning pin (hereinafter referred to as a "first positioning pin" for convenience) 15 is provided at its front end.

On the other hand, a guide device 5 is provided toward the back from both sides of the cutout portion 20*a* at an edge of the window S of the bottom plate 20*b*, and a pinhole (hereinafter referred to as a "first pinhole" for convenience) 25 in which the first positioning pin 15 is to be fitted is provided at a front edge of the window S (on the back side of the bottom plate 20*b*).

The base plate 24 in the line head 20 is slid and inserted into the guide groove 12, and the first positioning pin 15 in the line head 20 is fitted in the first pinhole 25 in the housing 11 so that the line head 20 is locked to the housing 11, as illustrated in FIG. 3(*b*). Details of a state where the first positioning pin 15 is fitted in the first pinhole 25 will be described below.

The inkjet recording apparatus 100 according to the present embodiment is of an attachment/detachment type in which the housing 11 is provided with the guide groove 12, and only the line head 20 is slid along the guide groove 12 when attached/detached. Therefore, its maintenance work becomes easy.

Special equipment for attachment/detachment of the line head 20 is not provided so that space saving and cost reduction can be achieved.

Further, the housing 11 is positionally-fixed to the frame of the inkjet recording apparatus 100, as described above. Therefore, pitch matching can be easily performed when the line head 20 is attached. Particularly, the line head 20 is locked to the housing 11 with the first positioning pin 15 provided at the front end of the line head 20. Therefore, pitch matching can be performed with higher accuracy when the line head 20 is attached to the housing 11.

Figure 4:
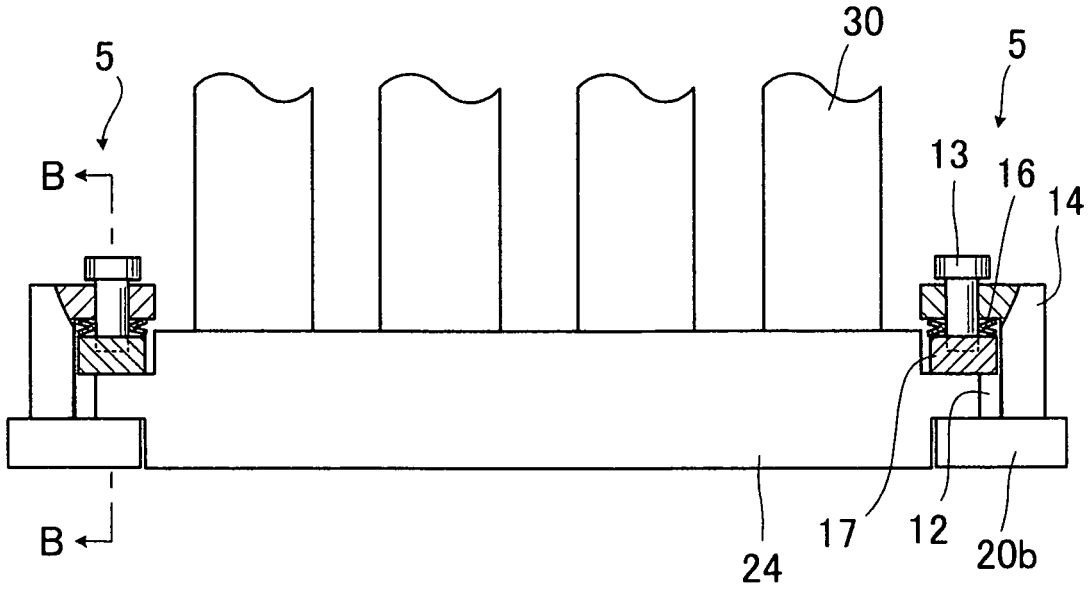
FIG. 4 is a partially sectional view taken along a line A-A illustrated in FIG. 3(*b*).

FIG. 4 is a partially sectional view taken along a line A-A illustrated in FIG. 3(*b*).

As illustrated in FIG. 4, the above-mentioned guide groove 12 is formed by a bottom plate 20*b*, and a bracket 14, which is in an inverted L shape in cross section, mounted on the bottom plate 20*b*. Both side ends of the base plate 24 in the line head 20 are slid and inserted into the guide groove 12.

The guiding device 5 includes a bracket 14, an urging plate 17 attached to the bracket 14 using a guide pin 13, and a spring member 16 for urging the urging plate 17.

In the guiding device 5, both side ends of the line head 20 are urged toward the bottom plate 20*b* via the urging plate 17 by an urging force of the spring member 16. More specifically, the guiding device 5 can be urged toward the bottom plate 20*b* at the same time that both the side ends of the line head 20 are guided.

In the above-mentioned inkjet recording apparatus 100, when both the side ends of the base plate 24 in the line head 20 are inserted into the guide groove 12, the spring member 16 urges the base plate 24 in the line head 20 downward via the urging plate 17 so that the line head 20 can be reliably positioned. In this case, a slight play space may preferably be provided between the base plate 24 and the bracket 14 in a horizontal direction of the guide groove 12. In this case, a mounting position of the line head 20 can be finely adjusted easily.

Figure 5:
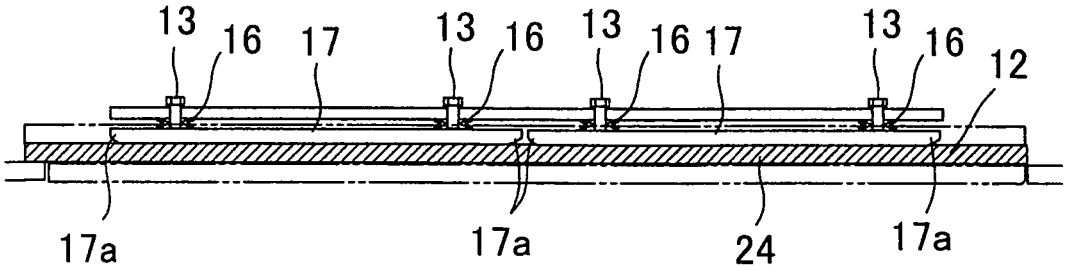
FIG. 5 is a partially sectional view taken along a line B-B illustrated in FIG. 4.

FIG. 5 is a partially sectional view taken along a line B-B illustrated in FIG. 4.

As illustrated in FIG. 5, the urging plate 17 is in a longitudinal plate shape, and spring members 16 are dotted on the urging plate 17. Thus, an urging force generated by the spring member 16 is uniformly transmitted to the base plate 24 in the line head 20 via the urging plate 17 guided to the guiding pin 13.

An end 17*a* of the urging plate 17 is a tapered curve. The line head 20 can smoothly perform an insertion operation without being caught thereon when it is attached/detached.

Therefore, the line head 20 can be reliably positioned. The line head 20 is not completely fixed. When a temperature environment changes, therefore, a force can be released even if a strain is generated due to a difference in coefficient of thermal expansion so that generation of a strain stress can be suppressed. Therefore, pitch accuracy of a nozzle can be maintained with high accuracy even if the temperature environment changes.

A state where the first positioning pin 15 is fitted in the first pinhole 25 will be described below.

Figure 6:
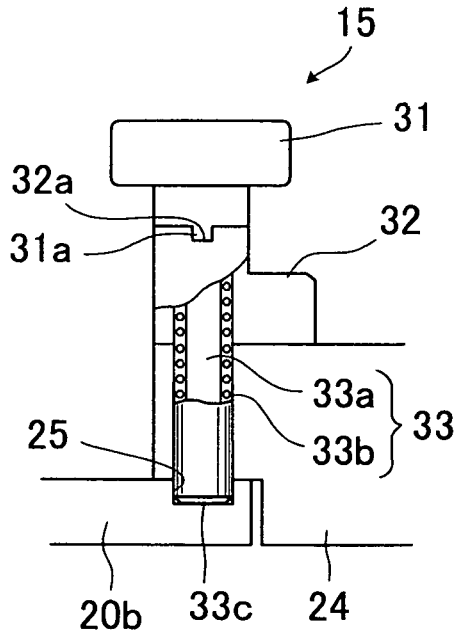
FIG. 6(*a*) is a partial sectional view for illustrating a state where a first positioning pin is fitted in a first pinhole in the inkjet recording apparatus according to the present embodiment, and FIG. 6(*b*) is a partially sectional view illustrating a state where the first positioning pin is removed from the first pinhole from the state illustrated in FIG. 6(*a*).
Figure 6:
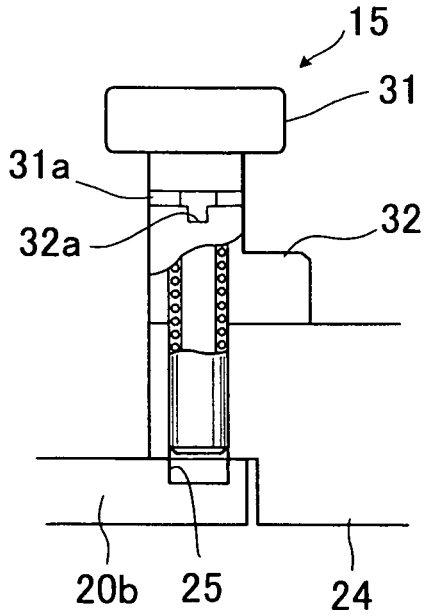

FIG. 6(*a*) is a partial sectional view for illustrating a state where the first positioning pin has been fitted in the first pinhole in the inkjet recording apparatus according to the present embodiment, and FIG. 6(*b*) is a partially sectional view illustrating a state where the first positioning pin has been removed from the first pinhole from the state illustrated in FIG. 6(*a*).

As described above, when the line head 20 is inserted into the back of the cutout portion 20*a* in the housing 11, the first positioning pin 15 is fitted in the first pinhole 25 to lock the line head 20 to the housing 11.

As illustrated in FIG. 6(*a*), the first positioning pin 15 in the line head 20 includes a knob 31 having a line-shaped projection 31*a* and a pin 33 linked to the knob 31 in its lower part, and a bracket 32 having a line-shaped groove 32*a* that can be fitted in the projection 31*a* and attached to the base plate 24 in the line head 20 in its lower part.

On the other hand, the first pinhole 25 that can be fitted in an end 33*c* of the pin 33 is provided in the bottom plate 20*b* in the housing 11.

In the inkjet recording apparatus 100, the projection 31*a* in the knob 31 is fitted in the groove 32*a* in the bracket 32, and the pin 33 is fitted in the first pinhole 25. Thus, the line head 20 is locked to the housing 11. The end 33*c* of the pin 33 is in a slightly tapered shape. Thus, the apparatus has the advantage that the pin 33 can be easily fitted in the first pinhole 25.

The pin 33 includes a core 33*a* that moves in synchronization with up-and-down movement of the knob 31, and a spring 33*b* provided to surround the core 33*a*. The spring 33*b* expands and contracts in synchronization with the up-and-down movement of the knob 31.

When the line head 20 is removed from the housing 11, the pin 33 may be pulled out of the first pinhole 25 by raising the knob 31, and placed on the top of the bracket 32 so that it is not fitted in the groove 32*a* by rotating the knob 31 through 90 degrees. At this time, the knob 31 is pulled up so that the core 33*a* is raised, and the spring 33*b* is compressed.

In the inkjet recording apparatus 100 according to the present embodiment, a cover 40 fixed along the guide groove 12 is disposed at a rear end of the line head 20.

Figure 7:
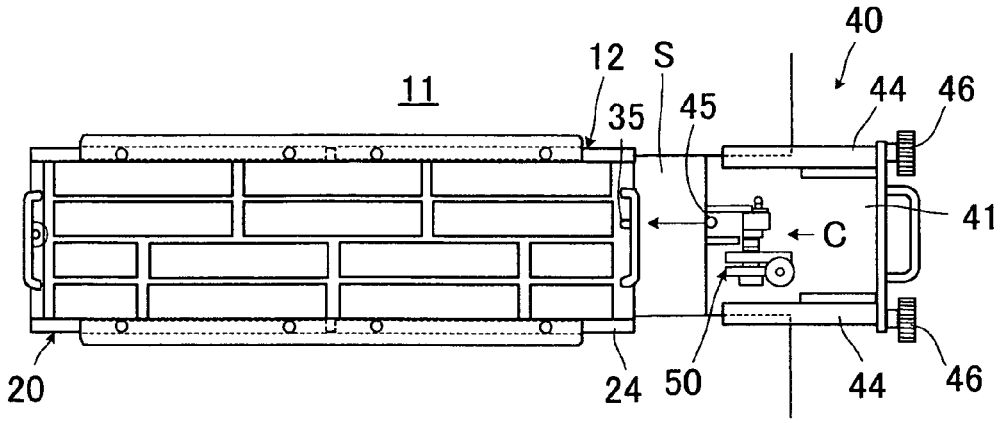
FIG. 7(*a*) is a top view illustrating a state where a cover has not been attached to a housing with a line head attached in the inkjet recording apparatus according to the present embodiment, and FIG. 7(*b*) is a top view illustrating a state where the cover has been attached to the housing with the line head attached.
Figure 7:
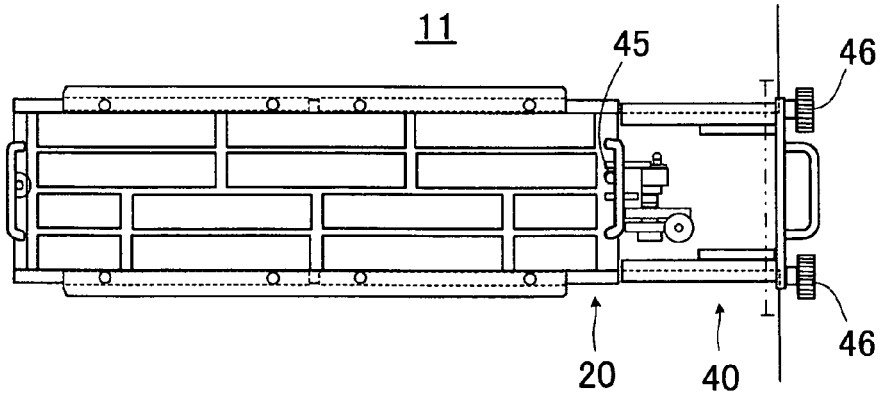

FIG. 7(*a*) is a top view illustrating a state where the cover has not been attached to the housing with the line head attached in the inkjet recording apparatus according to the present embodiment, and FIG. 7(*b*) is a top view illustrating a state where the cover has been attached to the housing with the line head attached.

As illustrated in FIG. 7(*a*), the cover 40 includes a substrate 41, guide plates 44 provided at both side ends of the substrate 41, a positioning pin (hereinafter referred to as a "second positioning pin" for convenience) 45 provided at a front end of the substrate 41, and fixing screws 46 for fixing the cover 40 to the housing 11. An adjustment device 50 for finely adjusting a position of the line head 20 after the cover 40 has been attached is attached to the second positioning pin 45. Details of the adjustment device 50 will be described below.

On the other hand, a pinhole (hereinafter referred to as a "second pinhole" for convenience) 35 in which the second positioning pin 45 is to be fitted is provided at the back (at the front) of the base plate 24 in the line head 20.

The guide plates 44 in the cover 40 are slid and inserted into an edge of the window S, and the second positioning pin 45 in the cover 40 is fitted in the second pinhole 35 in the base plate 24 in the line head 20 so that a rear end of the line head 20 is locked to the cover 40 by the second positioning pin 45 provided in the cover 40, as illustrated in FIG. 7(*b*). While a slight play is provided between the edge of the window S and the base plate 24, there is no play in a slidable range between the edge of the window S and the cover 40.

The cover 40 is fixed to the housing 11 with the fixing screw 46.

Thus, the line head 20 is further locked to the housing 11 via the cover 40.

In the inkjet recording apparatus 100 according to the present embodiment, a front end of the above-mentioned line head 20 is locked to the housing 11 with the first positioning pin 15. In addition thereto, a rear end of the line head 20 is locked to the housing 11 via the cover 40 with the second positioning pin 45.

Therefore, pitch matching can be performed with higher accuracy when the line head 20 is attached to the housing 11.

A state where the second positioning pin 45 is fitted in the second pinhole 35 will be described below.

Figure 8:
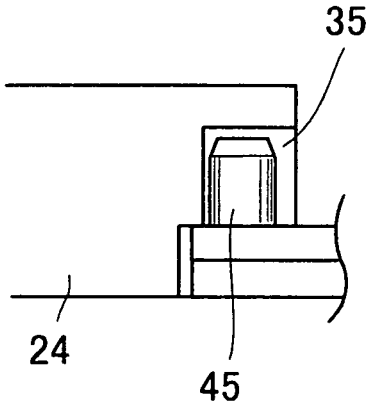
FIG. 8(*a*) is a side view for illustrating a state where a second positioning pin is fitted in a second pinhole in the inkjet recording apparatus according to the present embodiment, and FIG. 8(*b*) is a top view of a portion where the second positioning pin is fitted in the second pinhole.
Figure 8:
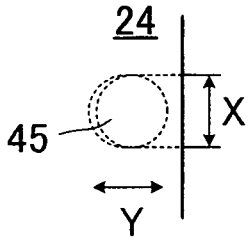

FIG. 8(*a*) is a side view for illustrating a state where the second positioning pin has been fitted in the second pinhole in the inkjet recording apparatus according to the present embodiment, and FIG. 8(*b*) is a top view of a portion where the second positioning pin has been fitted in the second pinhole.

As illustrated in FIGS. 8(*a*) and 8(*b*), when the cover 40 is attached to the front side of the line head 20, the second positioning pin 45 in the cover 40 is fitted in the second pinhole 35 in the base plate 24 in the line head 20 to lock the line head 20 to the housing 11.

At this time, in a transverse direction X perpendicular to an insertion direction of the line head, the second positioning pin 45 is locked to the second pinhole 35. In a longitudinal direction Y serving as the insertion direction of the line head, there may preferably be a play between the second positioning pin 45 and the second pinhole 35. Even if a dimensional change due to a temperature occurs in the base plate 24, therefore, its stretch margin is released so that positions in the transverse direction X of the second positioning pin 45 and the second pinhole 35 are accurately positionally-fixed.

The adjustment device 50 will be described below. The adjustment device 50 including the second positioning pin 45 is attached to the above-mentioned cover 40. The adjustment device 50 enables the line head 20 to slightly move.

Figure 9:
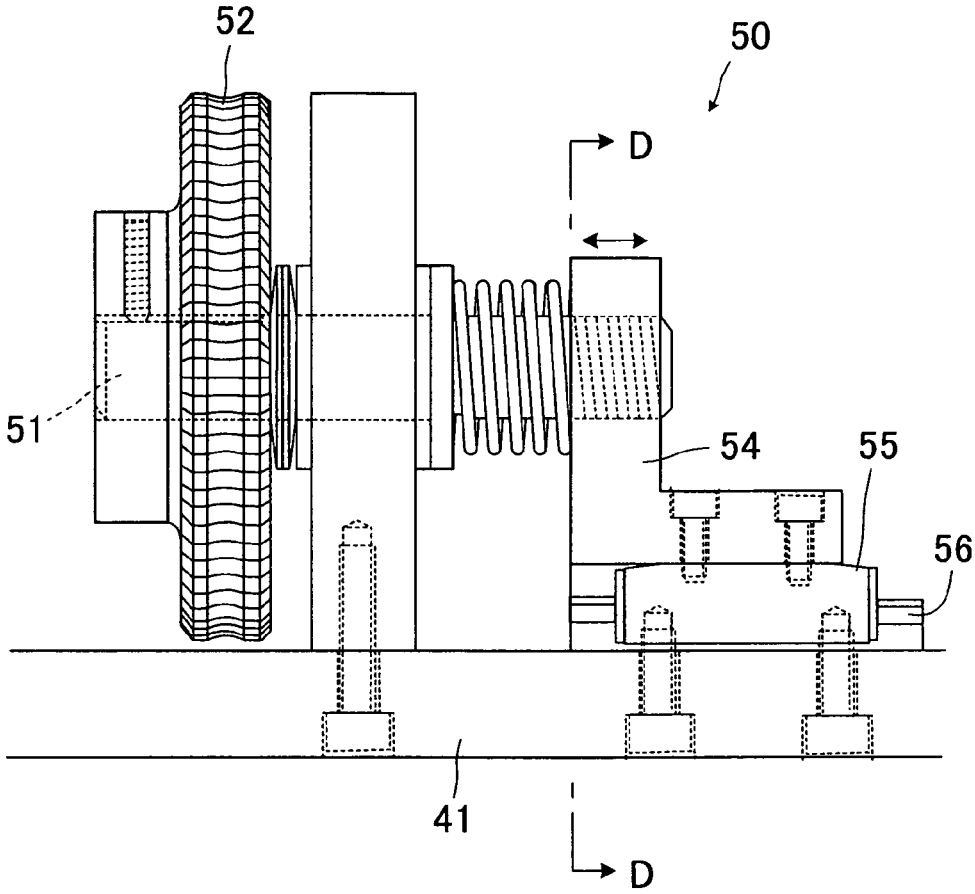
FIG. 9(*a*) illustrates an adjustment device in the inkjet recording apparatus according to the present embodiment is viewed in a C direction illustrated in FIG. 7(*a*), and FIG. 9(*b*) is a partially sectional view taken along a line D-D illustrated in FIG. 9(*a*).
Figure 9:
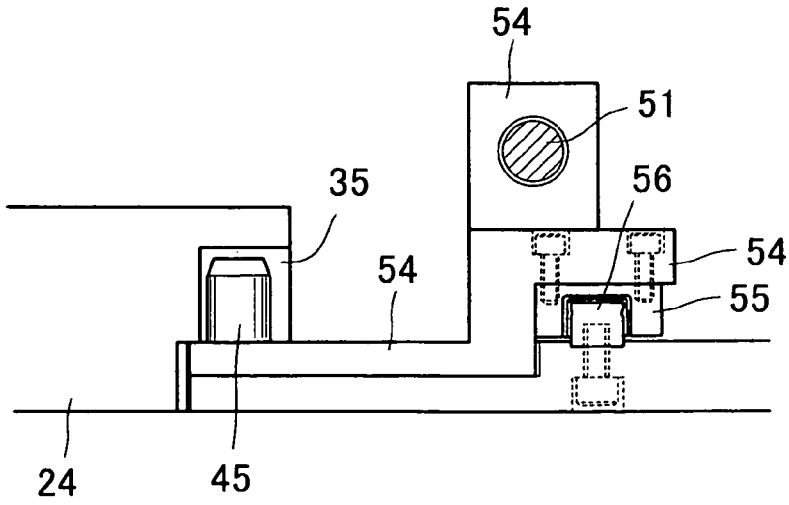

FIG. 9(*a*) illustrates the adjustment device in the inkjet recording apparatus according to the present embodiment as viewed in a C direction illustrated in FIG. 7(*a*), and FIG. 9(*b*) is a partially sectional view taken along a line D-D illustrated in FIG. 9(*a*).

As illustrated in FIGS. 9(*a*) and 9(*b*), the adjustment device 50 includes a slide bracket 54 with the second positioning pin 45 attached, a slider 55 fixed to the slide bracket 54, a guide 56 along which the slider 55 slides, a worm wheel shaft 51 connected to the slide bracket 54, a worm shaft for rotating the worm wheel shaft 51 via a worm wheel 52, and a handle (not illustrated) for rotating the worm shaft.

In the adjustment device 50, the worm wheel shaft 51 rotates via the worm wheel 52 by rotating the handle, and the slide bracket 54 and the slider 55 that are connected to each other linearly move along the guide 56 fixed to the substrate 41 in the cover 40 by a spring force. At this time, the second positioning pin 45 is fitted in the second pinhole 35, as described above. Therefore, the slide bracket 54 slightly moves while the second positioning pin 45 slightly moves.

Therefore, in the inkjet recording apparatus 100, the slide bracket 54 in the adjustment device 50 in the cover 40 is slightly moved so that the line head 20 slightly moves.

Therefore, pitch matching can be finely adjusted easily. The worm wheel 52 is fixed to a predetermined position by a locking mechanism (not illustrated) provided in the worm wheel shaft 51.

Although the embodiment of the present invention has been described above, the present invention is not limited to the above-mentioned embodiment.

Although the inkjet recording apparatus 100 according to the present embodiment includes the dryer 3 for heating and drying the recording medium 1 after printing, for example, the present invention is not limited to this. For example, the recording medium may be dried by a driver separately provided after printing is performed thereon.

The number of inkjet recording apparatuses 100 according to the present invention is not limited to one. A plurality of inkjet recording apparatuses may be arranged. For example, the first inkjet recording apparatus 100 may print a front surface of a recording medium, and the second inkjet recording apparatus 100 may print a back surface of the recording medium.

While the inkjet recording apparatus 100 according to the present embodiment includes the four line heads, it may include one to three line heads, or may include five or more line heads. The color of the ink to be injected into each of the line heads is not particularly limited. The ink may be a dye, a pigment, or the like, or may be a medicinal agent such as a glazing agent or a flameproofing agent. Further, it may be water-based or oil-based.

In the inkjet recording apparatus 100 according to the present embodiment, while the first positioning pin 15 in the line head 20 is fitted in the first pinhole 25 in the housing 11, the housing may have the first positioning pin, the line head may have the first pinhole, and the housing and the line head may be fitted to each other.

Similarly, while the second positioning pin 45 in the cover 40 is fitted in the second pinhole 35 in the base plate 24 in the line head 20, the line head may have the second positioning pin, the cover may have the second pinhole, and the line head and the cover may be fitted to each other.

While in the inkjet recording apparatus 100 according to the present embodiment, the spring member 16 is used to urge the urging plate 17, the spring member may be replaced with an elastic member, a spring, a rubber material, or the like.

While in the inkjet recording apparatus 100 according to the present embodiment, the cover 40 is used, the cover may not be used, and the second positioning pin may be directly provided in the housing, for example.

Structures of the first positioning pin 14 and the second positioning pin 45 in the inkjet recording apparatus 100 according to the present embodiment are not limited to the structures illustrated in FIGS. 6 and 8.

The recording medium 1 used in the inkjet recording apparatus 100 according to the present embodiment is not particularly limited to paper, a film, a metal foil, and so on.

INDUSTRIAL APPLICABILITY

An inkjet recording apparatus according to the present invention can be used as a recording apparatus for printing on a recording medium using an inkjet method. This inkjet recording apparatus can be easy to maintain and made compact.

DESCRIPTION OF REFERENCE NUMERALS

1 recording medium
2 guide roll
3 drier
10 inkjet recording head unit
11 housing
12 guide groove
13 guide pin
14 bracket
15 first positioning pin (positioning pin)
16 spring member
17 urging plate
17*a* end
20, 21, 22, 23 line head
20*a* cutout portion
20*b* bottom plate
24 base plate
25 first pinhole (pinhole)
30 rectangular head
31 knob
31*a* projection
32 bracket
32*a* groove
33 pin
33*a* core
33*b* spring
33*c* end
35 second pinhole
40 cover
41 substrate
44 guide plate
45 second positioning pin (positioning pin)
46 fixing screw
50 adjustment device
51 worm wheel shaft
52 worm wheel
54 slide bracket
55 slider
56 guide
100 inkjet recording apparatus
S window
X transverse direction
Y longitudinal direction

The invention claimed is:

1. An inkjet recording apparatus including a line head capable of printing on a recording medium, and a housing with the line head attached, wherein the line head is slid along a guide groove provided in the housing so that the line head is detachably attached, a cover positionally-fixed along the guide groove is disposed at a rear end of the line head, the rear end of the line head is locked to the cover with a second positioning pin, an adjustment device including the second positioning pin is attached to the cover, and the adjustment device enables the line head to slightly move.

2. The inkjet recording apparatus according to claim 1, wherein a front end of the line head is locked to the housing with a first positioning pin.

3. The inkjet recording apparatus according to claim 1, wherein the adjustment device includes a slide bracket with the second positioning pin attached, a slider fixed to the slide bracket, and a guide along which the slider slides, and the slide bracket and the slider are linearly movable along the guide fixed to the cover, and the line head is slightly movable by slightly moving the slide bracket.

4. The inkjet recording apparatus according to claim 1, wherein both side ends of the line head are urged toward a bottom plate of the housing at the same time that the side ends are guided by a guiding device provided in the housing.

5. The inkjet recording apparatus according to claim 4, wherein the guiding device includes a bracket, an urging plate attached to the bracket, and a spring member for urging the urging plate, and both the side ends of the line head are urged toward the bottom plate of the housing via the urging plate by an urging force of the spring member.

6. An inkjet recording apparatus comprising:

a housing having a groove therein;

a line head having a longitudinal axis, a first end, a second end, and a plate, the plate engaging the groove of the housing; and a cover attached to the second end of the line head and comprising an adjustment device configured to adjust the position of the line head in the direction of the longitudinal axis of the line head.

7. The inkjet recording apparatus according to claim 6, wherein the line head further comprises a pinhole adjacent the second end and the cover further comprises a positioning pin, the positioning pin being movably received in the pinhole.

8. The inkjet recording apparatus according to claim 6, wherein the plate of the line head comprises a bottom, and the housing further comprises a biasing member which biases the line head in the direction of the bottom of the plate.

* * * * *